US005711218A

United States Patent [19]

Kikuchi

[11] Patent Number: 5,711,218

[45] Date of Patent: Jan. 27, 1998

[54] LIGHT RADIATING DEVICE

[75] Inventor: Makoto Kikuchi, Inashiki-gun, Japan

[73] Assignee: Riso Kagaku Corporation, Tokyo, Japan

[21] Appl. No.: 638,047

[22] Filed: Apr. 26, 1996

[30] Foreign Application Priority Data

Apr. 28, 1995 [JP] Japan ..... 7-105603

[51] Int. Cl.[6] ..... B41C 1/055

[52] U.S. Cl. ..... 101/128.4; 362/301; 362/346

[58] Field of Search ..... 362/301, 346; 101/128.4, 128.21

[56] References Cited

U.S. PATENT DOCUMENTS

| | | | |
|---|---|---|---|
| 4,091,727 | 5/1978 | Hasegawa et al. | 101/128.4 |
| 4,335,421 | 6/1982 | Modia et al. | 362/301 |
| 4,347,554 | 8/1982 | Matsushita | 362/346 |
| 4,599,684 | 7/1986 | Lee | 362/346 |
| 4,754,375 | 6/1988 | Ferenc | 362/301 |
| 5,251,115 | 10/1993 | Hillman et al. | 362/346 |
| 5,313,379 | 5/1994 | Lemons et al. | 362/301 |

FOREIGN PATENT DOCUMENTS

| | | |
|---|---|---|
| 64-72883 | 3/1989 | Japan . |
| 1579458 | 11/1980 | United Kingdom . |
| 1579459 | 11/1980 | United Kingdom . |

OTHER PUBLICATIONS

Patent Abstracts of Japan, vol. 013, No. 274 (M-841), Matsushita Electric Ind, Co., Ltd., Jun. 23, 1989.

*Primary Examiner*—Edgar S. Burr
*Assistant Examiner*—Amanda B. Sandusky
*Attorney, Agent, or Firm*—Kanesaka & Takeuchi

[57] ABSTRACT

A light radiating device is formed of a casing having an opened lower surface arranged at a perforating plane of a heatsensitive stencil sheet; a light emitting device arranged within the casing; and reflection mirrors including lower side reflection mirror contacted with the perforating plane of the heatsensitive stencil sheet, an upper side reflection mirror in continuous with the lower side reflection mirror in a predetermined angle and an upper reflection mirror arranged in continuous with the upper side reflection mirror and in parallel with the perforating plane of the heatsensitive stencil sheet. The mirrors are arranged in the casing and reflect light from the light emitting means against the perforating plane of the heatsensitive stencil sheet.

4 Claims, 7 Drawing Sheets

LIGHT RADIATING DEVICE

BACKGROUND OF THE INVENTION

This invention relates to a light radiating device, for example, for radiating light against a heatsensitive stencil sheet overlapped on an original image in a heatsensitive perforating device in which an image is perforated in heatsensitive manner on the heatsensitive stencil sheet.

FIG. 5 is a perspective view for showing the prior art heatsensitive perforating device 1. In this figure, a pressing plate 3 is pivotally attached to a base 2. On the upper surface of the base 2 is arranged a base seat 4 on which an original is mounted. The lower surface of the pressing plate 3 opposing against the base seat 4 is provided with an opening 6 having a transparent plate 5 therein. At the lower surface side of the transparent plate 5 is removably installed an assembly of the heatsensitive stencil sheet. The assembly of a heatsensitive stencil sheet is made such that the heatsensitive stencil sheet made of a porous support member and a heatsensitive film adhered to the supporting member is fixed to one surface of a frame and one side edge of an ink impermeable sheet is adhered to the other surface of the frame.

As shown in FIG. 5, a light radiating device 10 is removably installed at the opening 6 of the pressing plate 3. The light radiating device 10 has an virtually quadrate pyramid casing 11. As shown in FIG. 6, flash bulbs 12 acting as light emitting means are removably arranged within the casing 11 of the light radiating device 10. In addition, an inner surface of the casing 11 is provided with reflection mirrors 13. The reflection mirrors 13 are comprised of an upper reflection mirror 14 in parallel with a perforating plane of the heatsensitive stencil sheet and arranged in the same plane as that of the base part of each of the flash bulbs 12; and side reflection mirrors 15 arranged in a predetermined angle in respect to the perforating plane of the heatsensitive stencil sheet.

An original is placed on the base seat 4 of the base 2, the assembly of the heatsensitive stencil sheet is supported on the transparent plate 5 of the pressing plate 3 and then the light radiating device 10 is installed at the opening 6 of the pressing plate 3. As the pressing plate 3 is pressed against the base 2, the heatsensitive stencil sheet of the heatsensitive stencil sheet assembly is closely contacted with the original, so that a switch mechanism not shown in the figure is concurrently closed to cause the light radiating device 10 to be operated. The flash bulbs 12 may generate flash light and this flash light passes through the transparent plate 5 and the heatsensitive stencil sheet to cause an image in the original to be heated. A heatsensitive film of the heatsensitive stencil sheet is formed with perforated images corresponding to the image in the original.

This heatsensitive perforating device 1 is utilized as a printing device after perforating sheet. That is, the ink impermeable sheet of the assembly is opened, ink is placed on the heatsensitive stencil sheet within the frame and again the ink impermeable sheet is closed. This assembly of the heatsensitive stencil sheet is supported at the pressing plate 3 with the heatsensitive stencil sheet being faced down. If a printing sheet is placed on the base seat 4 of the base 2 and the pressing plate 3 is pressed against the base 2, the heatsensitive stencil sheet of the assembly is pushed against the printing sheet and then a printing is applied to the printing sheet.

In the perforating process performed in the aforesaid heatsensitive perforating device 1 of the prior art, although the flash light for thermally perforating the heatsensitive stencil sheet is radiated in a substantial radial direction from the flash bulbs 12, and the light includes a light reaching directly to the heatsensitive stencil sheet (a direct light) and a light reaching to the heatsensitive stencil sheet after being reflected against the reflection mirror 13 (an indirect light).

In the light radiating device 10 of the prior art heatsensitive perforating device 1, all the light beams reflected against the reflection mirror 13 do not uniformly reach the heatsensitive stencil sheet in such a manner that a distribution of amount of light on the heatsensitive stencil sheet may become uniform. That is, sometimes a poor perforating occurred due to a lack of amount of light at the outer circumference of the perforating plane of the heatsensitive stencil sheet. This inconvenient phenomenon is easily and remarkably present in particular in the case that the image is formed on either the entire surface of the perforating plane or approximate entire surface or in the case that a solid area is present at the outer circumference of the perforating plane.

SUMMARY OF THE INVENTION

It is an object of the present invention to provide a light radiating device capable of performing a uniform perforating over an entire surface of the perforating plane of the heatsensitive stencil sheet even in the case that an image is formed approximately over an entire surface of the perforating plane or in the case that a solid area is present at the outer circumference of the perforating plane.

A light radiating device according to a first aspect of the invention is comprised of a casing having an opened lower surface arranged at a perforating plane of a heatsensitive stencil sheet; light emitting means arranged within the casing; and reflection mirrors arranged in the casing and reflecting light from the light emitting means against the perforating plane of the heatsensitive stencil sheet. The reflection mirrors include lower side reflection mirror to be contacted with the perforating plane of the heatsensitive stencil sheet, an upper side reflection mirror in continuous with the lower side reflection mirror in a predetermined angle and an upper reflection mirror arranged in continuous with the upper side reflection mirror and in parallel with the perforating plane of the heatsensitive stencil sheet.

A light radiating device according to a second aspect of the invention is characterized in that the upper side reflection mirror and the lower side reflection mirror are plane reflection mirrors.

A light radiating device according to a third aspect of the invention is characterized in that an angle between the lower side reflection mirror and the perforating plane of the heatsensitive stencil sheet is a right angle.

A light radiating device according to a fourth aspect of the invention is characterized in that upper end of the lower side reflection mirror is placed lower than the lower end of the light emitting means.

A light radiating device according to a fifth aspect of the invention is characterized in that each of the upper side reflection mirror and the lower side reflection mirror is comprised of a plurality of planes and an interface part at the adjoining planes of said lower side reflection mirror is a curved surface.

According to the aforesaid configuration, at least the following actions can be attained. Light reaching directly the lower side reflection mirrors from the light emitting means is reflected there and reaches the outer circumference of the perforating plane. At least a part of the light reflected at the upper side reflection mirror is reflected again at the lower side reflection mirrors and reaches the outer circumference of the perforating plane. At the outer circumference of the perforating plane where a less amount of light directly reaching from the light emitting means, a density of the light reflected at the reflection mirrors and indirectly reaching is increased and then a uniform perforating is carried out over the entire surface of the perforating plane.

BRIEF DESCRIPTION OF THE DRAWINGS

FIG. 3(*b*) is a view for showing a temporary reflecting state in a light radiating device in the first preferred embodiment of the present invention;

DESCRIPTION OF THE PREFERRED EMBODIMENT

Referring now to FIGS. 1 to 4, a light radiating device 20 of a heatsensitive perforating device of a first preferred embodiment of the present invention will be described. The heatsensitive perforating device to which the present light radiating device 20 is applied is the same as the prior art heatsensitive perforating device 1 described in reference to FIG. 5.

Figure 1:
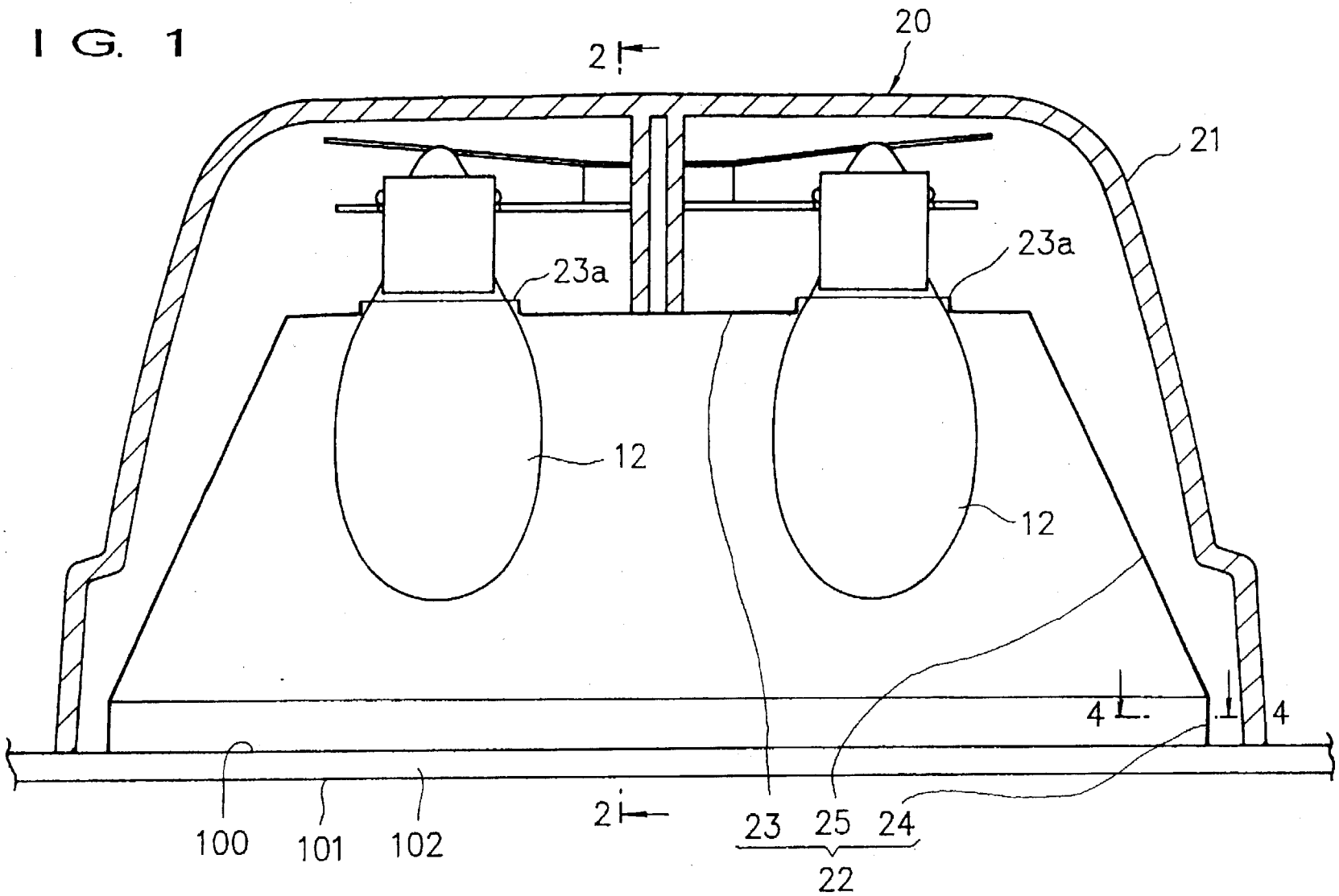
FIG. 1 is a sectional view for showing a first preferred embodiment of the present invention.
Figure 2:
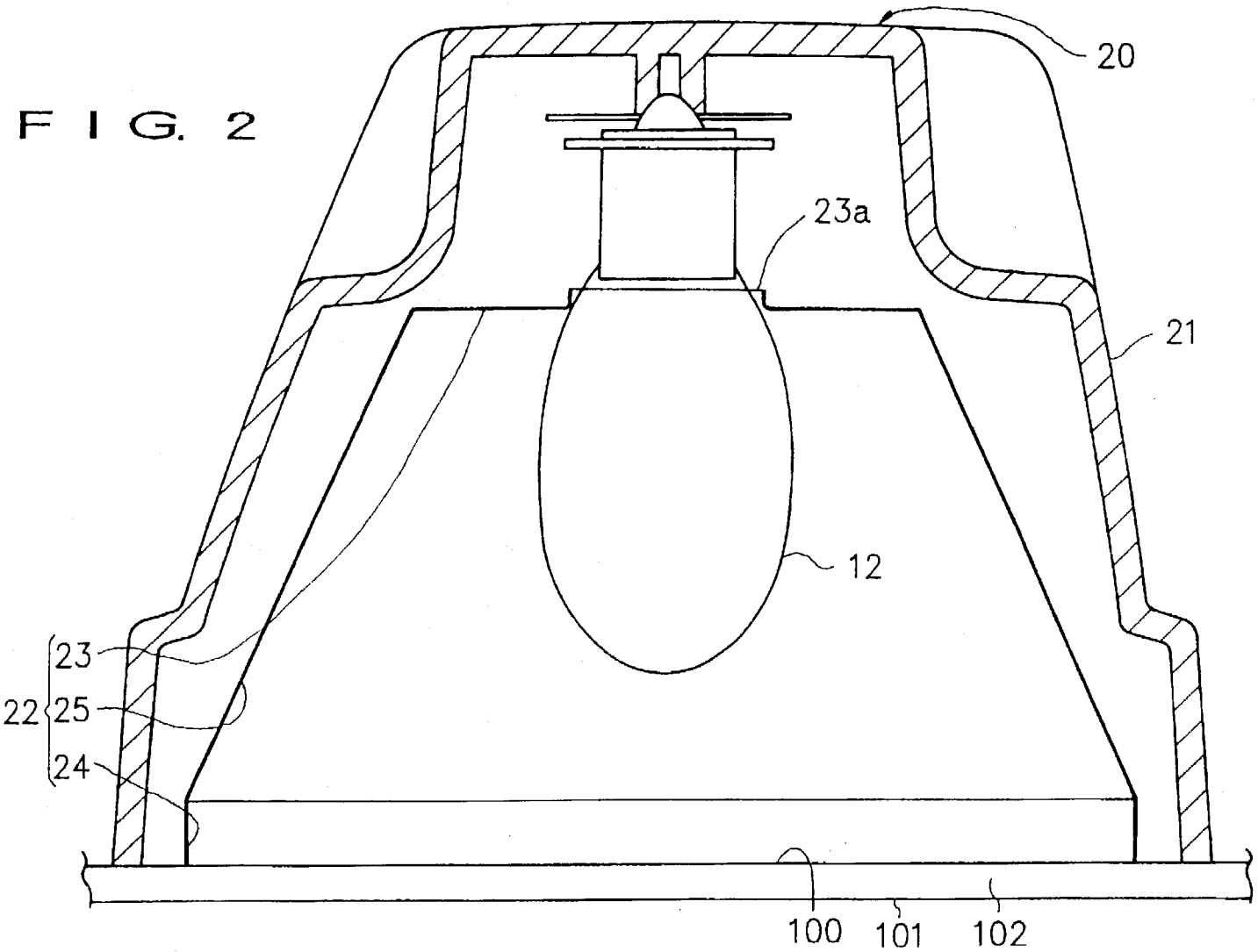
FIG. 2 is a sectional view taken along a line 2—2 of FIG. 1.

As shown in FIGS. 1 and 2, the light radiating device 20 of the preferred embodiment has a casing 21 of virtually quadrate pyramid. The bottom surface of the casing 21 is released to open and this bottom surface is contacted with a transparent plate 102 arranged at a pressing plate of the heatsensitive perforating device. The lower surface of the transparent plate 102 is used as a perforating surface 101 of a heatsensitive stencil sheet under which a heatsensitive stencil sheet is closely contacted. At the inner surface of the casing 21 is arranged a reflection mirror 22 of virtually quadrate pyramid shape. This reflection mirror 22 is also released to open at its bottom surface. The reflection mirror 22 is comprised of one upper surface reflection mirror 23 opposing against and in parallel with a perforating plane of the heatsensitive stencil sheet; lower reflection mirrors 24 with four side surfaces contacted with the perforating plane of the heatsensitive stencil sheet and raised vertically from the perforating plane; and upper reflection mirrors 25 with four side surfaces arranged between the each of the lower side reflection mirrors 24 and the upper reflection mirror 23 and kept in continuous with the lower reflection mirrors 24 in a predetermined angle. The lower side reflection mirrors 24 and the upper side reflection mirrors 25 are in a plane form.

Figure 7:
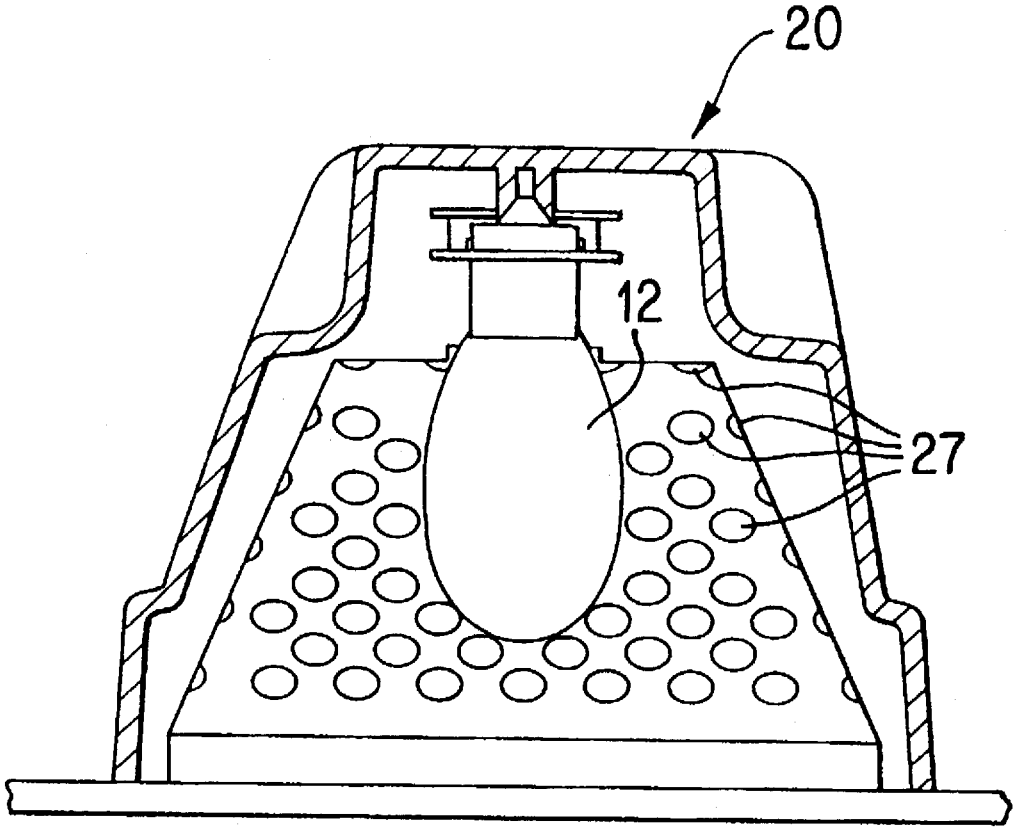
FIG. 7 is a sectional view, similar to FIG. 2, for showing semi-protrusions on the mirrors.

The reflection mirrors of the present preferred embodiment are made of aluminum. The upper surface reflection mirror 23 and the upper side reflection mirrors 25 are formed with many approximate semi-spherical protrusions 27 (FIG. 7). Since light emitted from flash bulbs is dispersed by these protrusions, non-uniformity state given to the perforated sheet in the perforating process caused by a difference of the flash bulbs is reduced.

Flush bulbs 12 acting as light emitting means are fixed to the holes 23*a* formed in the upper side reflection mirror 23 in such a manner that the bulbs may be replaced. Flash bulbs 12 are electrically energized by a power supply (not shown) installed in the heatsensitive perforating device so as to discharge light when predetermined perforating operations such as mounting the present light radiating device 20 on the pressing plate 3 of the heatsensitive perforating device and pushing the pressing plate 3 against the base 2 or the like are carried out. As the light emitting means, a radiation bulb or the like may be used.

One example of practical shape and size in the present light radiating device 20 will be described as follows. A size of the opening 100 at the bottom surface of the reflection mirror 22 is a rectangular shape of 150 mm×102 mm which is adapted for a perforating process for a post card. A spacing between the opening 100 at the bottom surface of the reflection mirror 22 and the upper surface reflection mirror 23 is 59 mm. The opening 100 at the bottom surface of the reflection mirror 22 is contacted with the transparent plate 102 having a thickness of 4 mm arranged at the pressing plate of the heatsensitive perforating device, and the lower surface of the transparent plate 102 is used as the perforating plane 101 of the heatsensitive stencil sheet. Accordingly, a spacing between the perforating plane 101 of the heatsensitive stencil sheet and the upper reflection mirror 23 is 63 mm. The lower side reflection mirrors 24 are vertically raised from the opening 100 at the bottom surface of the reflection mirror 22 and a size of the raised part is 6 mm. A spacing between the lower end of each of the flash bulbs 12 and the opening 100 at the bottom surface of the reflection mirror 22 is 20 mm. Accordingly, a spacing between the lower end of each of the flash bulbs 12 and the perforating plane 101 of the heatsensitive stencil sheet is 24 mm. In the preferred embodiment, the upper ends of the lower side reflection mirrors 24 are placed at positions lower than those of the lower ends of the flash bulbs 12. An angle between the lower side reflection mirror 24 and the upper side reflection mirror 25 is 155°.

Figure 3A:
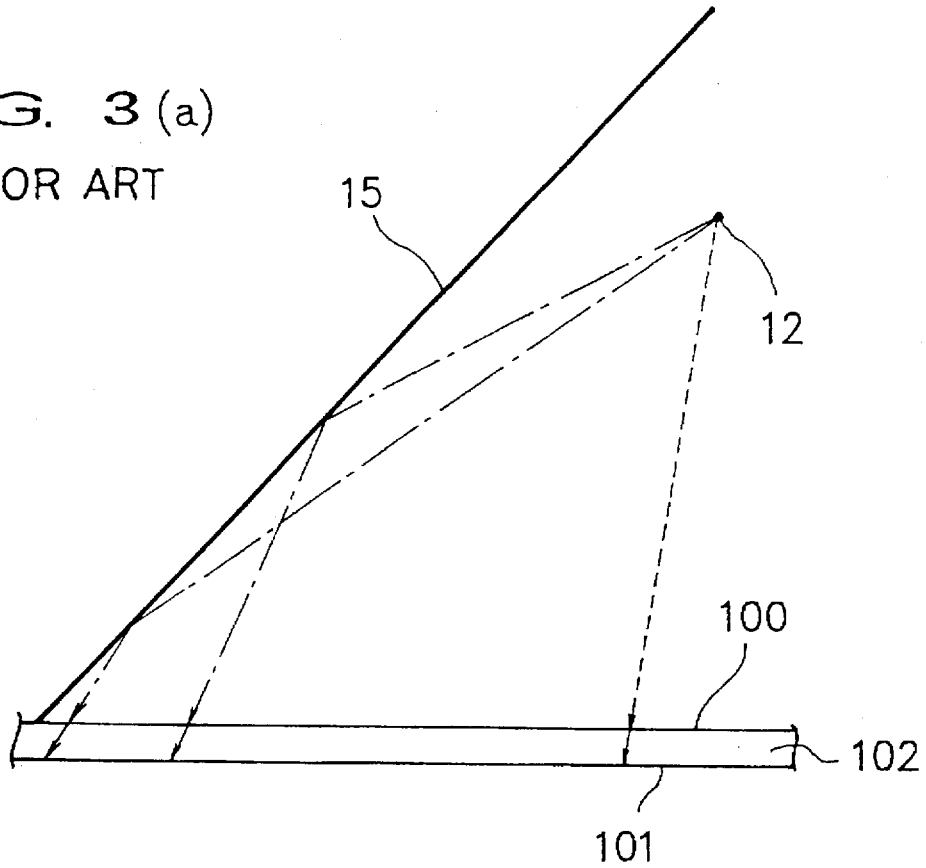
FIG. 3(a) PRIOR ART
FIG. 3(*a*) is a view for showing a temporary reflecting state in the prior art light radiating device.
Figure 3B:
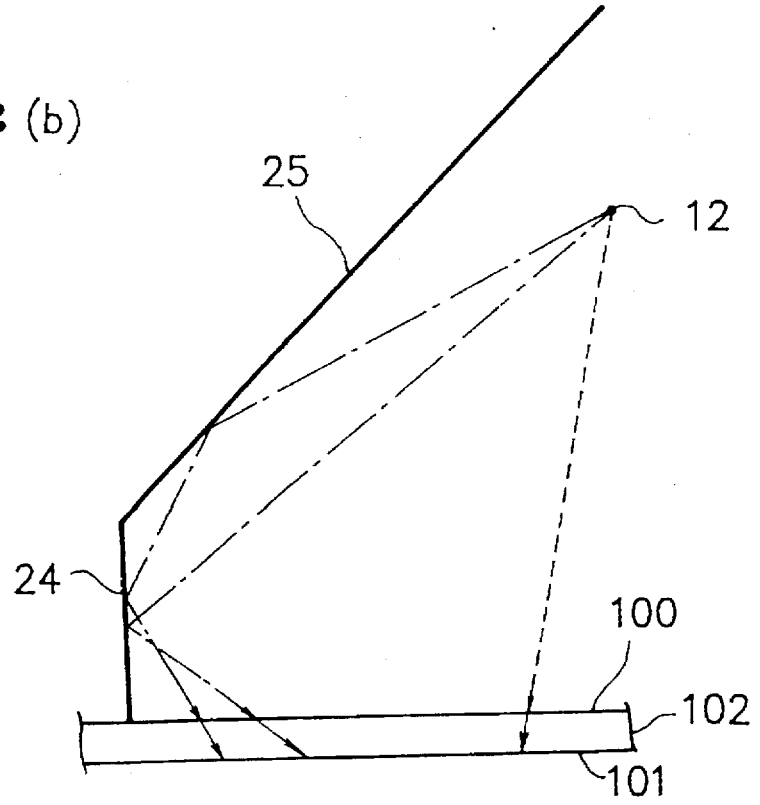

FIG. 3(*a*) indicates a light path at the prior art reflection mirror. FIG. 3(*b*) indicates a light path in the preferred embodiment which is similar to that of FIG. 3(*a*). In FIG. 3(*b*), light directly reaching from the light emitting means (the flash bulb 12) the lower side reflection mirror 24 is reflected there and reaches the outer circumference of the perforating plane 101. In addition, at least a part of the light reaching from the light emitting means (flash bulb 12) the upper side reflection mirror 25 and reflected at the upper side reflection mirror 25 is reflected again at the lower side reflection mirror 24 and reaches the outer circumference of the perforating plane 101. The light reflected by the upper side reflection mirror 25 and the lower side reflection mirror 24 and reaching the perforating plane 101 is defined as an indirect light and this light is indicated by an one-dotted line in FIG. 3(*b*). In addition, the light reflected at the side reflection mirror 15 and incident to the perforating plane 101 in the light path in the prior art reflection mirror shown in FIG. 3(*a*) is an indirect light and this light is indicated by an one-dotted line in this figure. The light reaching directly from the light emitting means, i.e. the direct light indicated by a broken line in FIGS. 3(*a*) and (*b*) is less at the outer circumference of the perforating plane 101. However, in the preferred embodiment shown in FIG. 3(*b*), a density of the indirect light reflected at the upper side reflection mirror 25 and the lower side reflection mirror 24 and indirectly reaching the perforating plane becomes higher as compared with the case shown in FIG. 3(*a*). Accordingly, in the preferred embodiment, a uniform perforating process is carried out over an entire surface of the perforating plane 101 as compared with that of the prior art.

Figure 4:
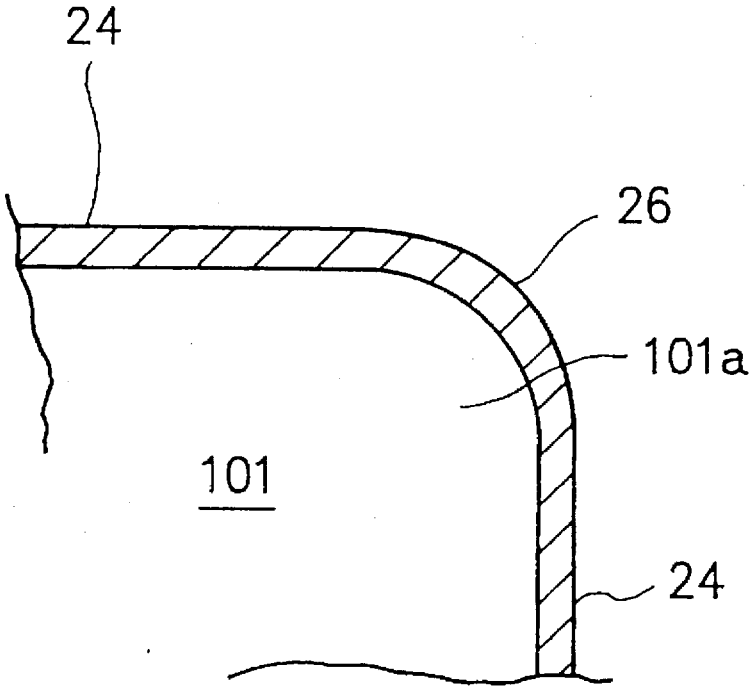
FIG. 4 is a sectional view for showing another state of a reflection mirror in the light radiating device of the first preferred embodiment of the present invention and this figure corresponds to the sectional view taken along a line 4—4 of FIG. 1.
Figure 5:
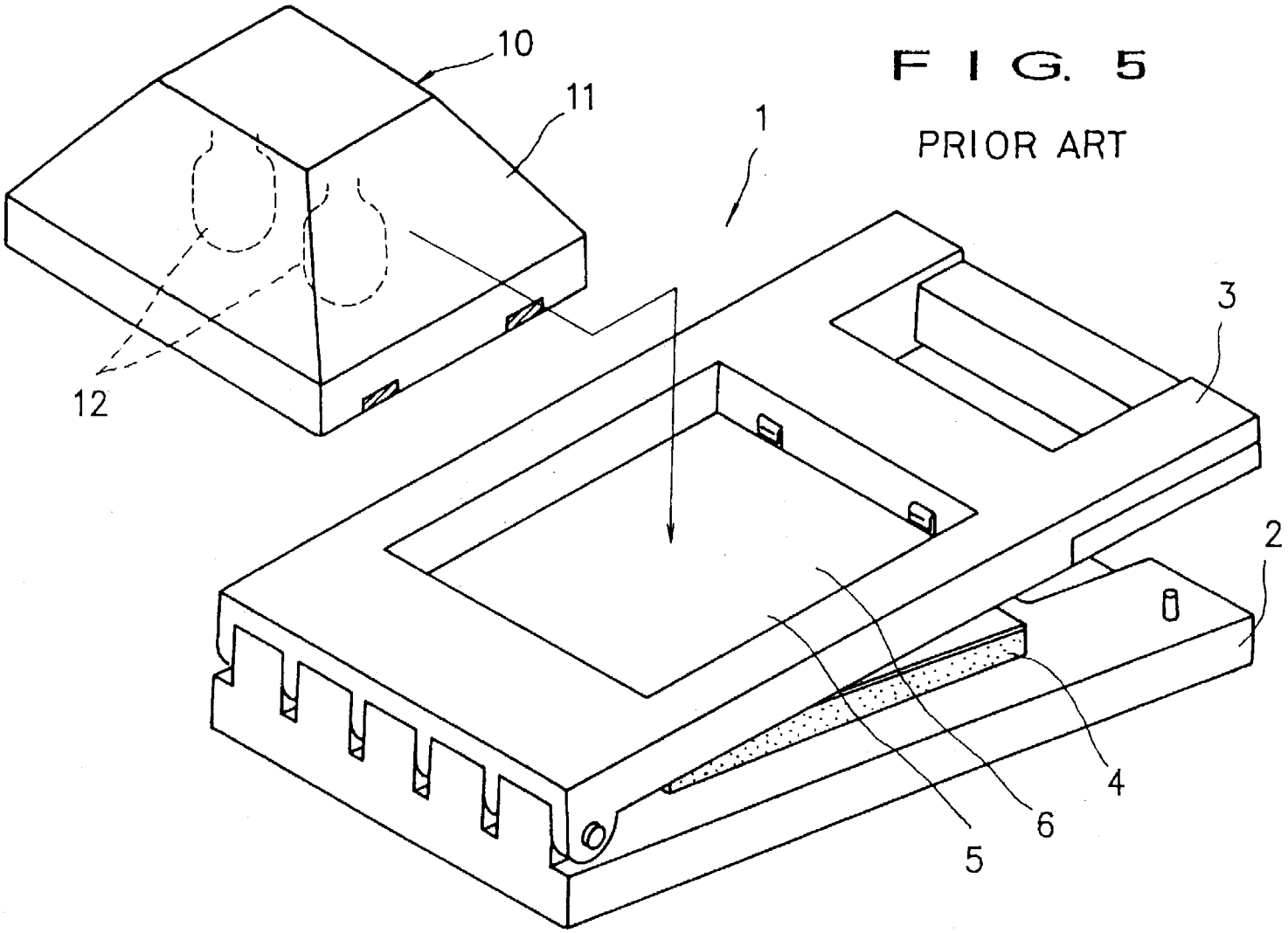
FIG. 5 PRIOR ART
FIG. 5 is a perspective view for showing a heatsensitive perforating device having the prior art light radiating device.
Figure 6:
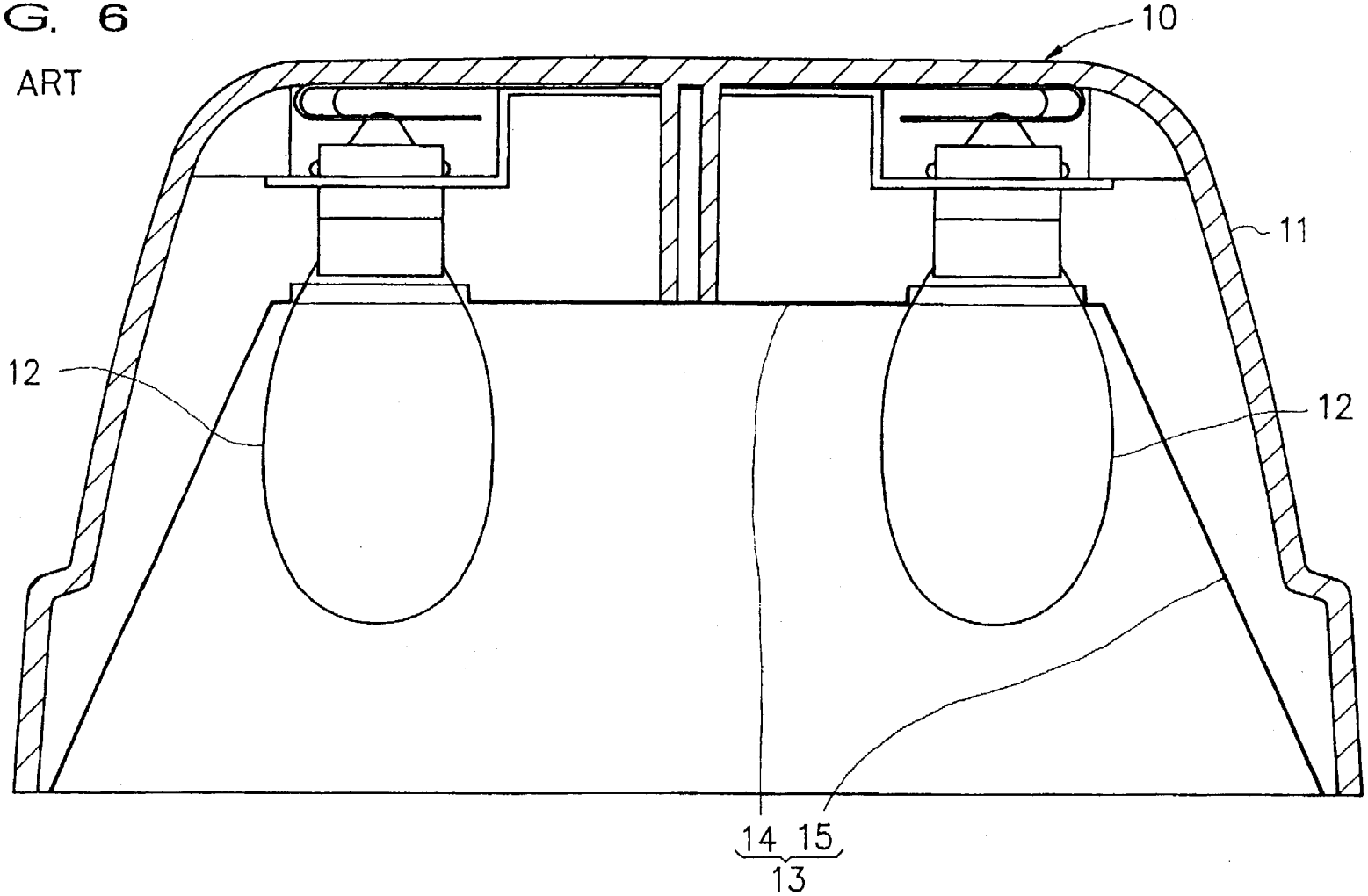
FIG. 6 PRIOR ART
FIG. 6 is a sectional view for showing the prior art light radiating device.

As shown in FIG. 4, if the interface part 26 between the adjoining lower side reflection mirrors 24, 24 is formed into a curved surface, it is possible to cause a large amount of light as compared with that of the prior art to reach the outer circumference of the perforating plane 101 of the heatsensitive stencil sheet, in particular, a corner part 101*a* where light is hardly collected. Accordingly, if the interface part 26 of the adjoining lower side reflection mirrors 24 is formed into a curved surface as shown in FIG. 4 in the preferred embodiment, it is possible to perform a more uniform perforating process of the heatsensitive stencil sheet.

The angle between the lower side reflection mirror 24 and the upper side reflection mirror 25 and the angle between the perforating plane 101 of the heatsensitive stencil sheet and the lower side reflection mirror 24 are not limited to those of the aforesaid preferred embodiment unless an angle formed between the inner surface of the lower side reflection mirror 24 and the perforating plane 101 is larger than a right angle (in obtuse angle), and these angles can be properly set in such a manner that the reflection light can be collected more uniformly than that of the prior art as well as at the outer circumferential surface of the perforating plane 101.

In accordance with the present invention, since the upper side reflection mirror is arranged in a predetermined angle in continuous with the lower side reflection mirror contacted with the perforating plane of the heatsensitive stencil sheet in the light radiating device of the heatsensitive perforating apparatus, a density of light reflected at the reflection mirror and reaching indirectly is increased at the outer circumference of the perforating plane where light reaching directly from the light emitting means is less in volume and then a uniform perforating process is carried out over an entire surface of the perforating plane.

What is claimed is:

1. A light radiating device for a heatsensitive stencil sheet, comprising:

a casing having an opened lower surface adapted to be placed on a perforating plane of the heatsensitive stencil sheet;

light emitting means situated in said casing; and reflection mirrors situated in the casing, said reflection mirrors including a lower side plane reflection mirror adapted to contact the perforating plane; an upper side plane reflection mirror extending continuously from the lower side reflection mirror with a predetermined angle thereto and having a plurality of semi-spherical protrusions integrally formed therewith; and an upper plane reflection mirror extending continuously from the upper side reflection mirror and being disposed parallel to the perforating plane, said upper plane reflection mirror having a plurality of semispherical protrusions integrally formed therewith so that when the light emitting means is actuated, light from the light emitting means is reflected at the reflection mirrors with the semi-spherical protrusions and adapted to be uniformly irradiated onto the perforating plane.

2. A light radiating device as set forth in claim 1 in which an angle between said lower side reflection mirror and the perforating plane of said heatsensitive stencil sheet is a right angle.

3. A light radiating device as set forth in claim 2 in which an upper end of said lower side reflection mirror is placed lower than a lower end of said light emitting means.

4. A light radiating device as set forth in claim 3 in which each of said upper side reflection mirror and said lower side reflection mirror is comprised of a plurality of planes and an interface part between adjoining planes of said lower side reflection mirror is a curved surface.

* * * * *